United States Patent [19]

Hopkins

[11] 4,004,519

[45] Jan. 25, 1977

[54] PROJECTILE POWER GENERATOR

[75] Inventor: Wayne J. Hopkins, College Park, Md.

[73] Assignee: The United States of America as represented by the Secretary of the Navy, Washington, D.C.

[22] Filed: Apr. 12, 1976

[21] Appl. No.: 676,018

[52] U.S. Cl. ..... 102/70.2 G

[51] Int. Cl.[2] ..... F42C 11/04

[58] Field of Search ..... 102/70.2 G, 70.2 P, 102/70.2 R; 244/3.23

[56] References Cited

UNITED STATES PATENTS

| | | | |
|---|---|---|---|
| 2,468,120 | 4/1949 | Senn | 102/70.2 G |
| 2,681,008 | 6/1954 | Allen | 102/70.2 G |
| 2,804,824 | 9/1957 | Cruzan | 102/70.2 G |
| 2,920,568 | 1/1960 | Rabinow | 102/70.2 G |
| 3,027,842 | 4/1962 | Hopkins | 102/70.2 P |
| 3,124,073 | 3/1964 | Khouri et al. | 102/70.2 P |
| 3,170,403 | 2/1965 | Heilprin | 102/70.2 G |
| 3,611,943 | 10/1971 | Popper | 102/70.2 G |
| 3,772,992 | 11/1973 | Moore et al. | 102/70.2 G |
| 3,826,193 | 7/1974 | Rognmo et al. | 102/70.2 G |

FOREIGN PATENTS OR APPLICATIONS

| | | | |
|---|---|---|---|
| 304,254 | 10/1920 | Germany | 102/70.2 G |

*Primary Examiner*—Charles T. Jordan

[57] ABSTRACT

A system for generating electrical power comprising a stator in combination with an air driven turbine type rotor of annular shape and supported for rotation on an outer surface of the unit to which power is to be supplied. Aerodynamically responsive fins on the annulus ring when exposed to the air flow, rotate the annulus. Magnets in the annulus are separated from stationary stator coils embedded in the unit to generate alternating current.

6 Claims, 3 Drawing Figures

PROJECTILE POWER GENERATOR

BACKGROUND OF THE INVENTION

This invention relates to projectile fuses and more particularly to fuses having an air driven generator as the electrical power source.

Various types of ordnance missiles are provided with electrical and/or electronic fuses that are target seeking. Such fuses require that a constant electrical current be supplied to fuse elements when the fuse is required to be maintained in the target seeking condition. Common types of batteries have been found to be unsuitable for this purpose. These batteries cannot be fully tested prior to their use, and become relatively inactive at low temperatures. Reserve type batteries designed for low temperature operation are not completely satisfactory due to their requirements for and sensitivity to the spin of the projectile fuse.

Generators provided with wind vances or air driven turbines have ben used and have given satisfactory performance. A common approach has been to ram air into and through a central axial bore located in the nose of the fuse. The rotating turbine includes a generator rotor, a central axial shaft therefor, and bearing means rotatably suppporting the shaft. The turbine is rotated by the axial flow of ram air to drive a generator that supplies the fuse with electrical power. This approach is not satisfactory for use with fuses that utilize radio frequency or optical firing systems. Such systems require that the projectile nose be devoted to target seeking or detection means, such as an antenna, lens, or optical path responsive devices. Furthermore, since the electrical signals from these devices are typically very weak, part of the target signal detection processor should be located as close to the antenna or optical system as possible, preferably back to back. These two requirements preclude the use of a power generator that must either draw air in from a central bore or have a turbine rotating about a central axial shaft, since both must occupy critical interal volume along the longitudinal axis of the projectile.

A more ideal fuse would be one that permits the target seeking and processing apparatus to be housed in the forwardmost section of the fuse in such a manner that the seeking means have an unobstructed view and be adjacent the processing means, and one which provides an electrical power generating source that does not alter the projectile's exterior geometry or consume excessive fuse internal volume.

SUMMARY OF THE INVENTION

Accordingly, one object of this invention is to provide a simple source of electrical power for fuses.

Still another object of this invention is to provide an improved power generator for fuses which permits substantially all of the internal fuse volume to be devoted to fuse target electronics.

A further object is to provide an air driven turbine power generator which is simple in operation and which does not obstruct internal packaging of fuse electronic elements.

Briefly, in accordance with one embodiment of this invention, these and other objects are attained by encircling the external surface of the fuse housing with an annular shaped rotor having a plurality of fins disposed on the rim to extract energy from the air stream and thereby rotate the annulus. A stator, comprised of a series of coils is embedded in an annular fuse housing depression. Magnets, which are separated from the stator, are disposed in the rotor to generate electrical current. The fuse basically comprises a forward nose housing, an intermediate power generator housing section, and an aft housing, each of which is disposed about an axis corresponding to the projectile's longitudinal axis. The forward and intermediate sections are aerodynamically designed so as to provide a streamlined connection with the projectile. The aft housing is designed to be received within a projectile well. The fuse nose is preferably ogive in shape and serves as a housing for projectile target seeking means, such as an antenna. The electrical power generating annulus is adapted to rotate about the intermediate housing section. Target processing equipment is thereby provided with the largest possible housing chamber volume in the intermediate section.

BRIEF DESCRIPTION OF THE DRAWING

A more complete appreciation of the invention and many of the attendant advantages thereof will be readily appreciated as the same becomes better understood by reference to the following detailed description when considered in connection with the accompanying drawings wherein.

FIG.. 3 is a partial view to an enlarged scale of an alternative power generator embodiment.

DESCRIPTION OF THE PREFERRED EMBODIMENT

Figure 1:
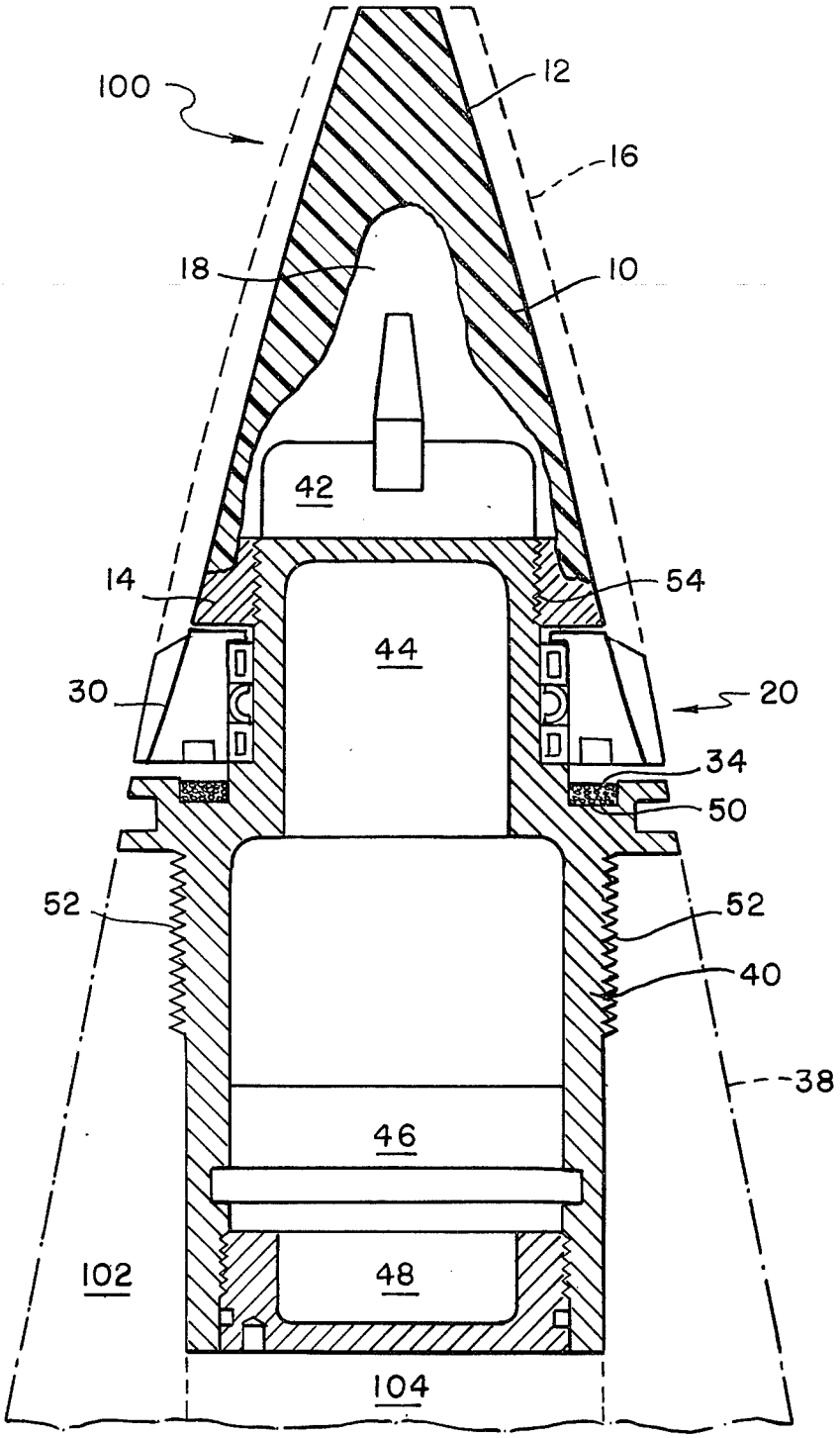
FIG. 1 is a longitudinal cross section of a projectile fuse embodying the present invention.

Referring now to the drawings wherein like reference characters designate identical or corresponding parts throughout the views, and more particularly to FIG. 1, there is shown an electric powered proximity fuse 100 affixed to a projectile 102 (shown in phantom) containing an explosive charge 104 therein (shown in phantom). Fuse 100 is shown as comprising a central alternator section 20 interposed between a nose section 10 and a substantially cylindrical aft section 40.

The aft section 40 has a central, externally-threaded portion 52 for attachment of the fuse to the projectile. A forward, externally thread portion 54 provides for attachment of nose 10 to the fuse. The primary function of the aft section 40 is the housing of the target responsive electronic means, shown generally to include target detecting means 42, mounted externally on a forward bulkhead of the section, said means providing target responsive signals to internally-housed signal processing means 44, safety and arming means 46, and a booster 48. Electrical power for these target responsive means is generated by the alternator 20 disposed about an external section of the housing aft of the nose 10.

The fuse external contour is streamlined so as to provide the projectile with favorable aerodynamic features and to reduce the drag effects acting on the projectile. The external contour 12 of the external fuse nose 10 is defined to meet these requirements. An ogive represents one suitable contour. The external surface 30 of the alternator 20 aft of the nose 10 continues the streamlining contour 12, flaring out gradually until the external contour 38 of the projectile 102 is reached. An interior chamber 18 of the nose permits housing of the target seeking means and also serves to shield the signal means from the airstream. However, the nose itself is transparent to the transmission/reception of electromagnetic/electro-optical target signals. For example, the nose could be made from Teflon and be crimped onto a receiving ring, or injection molded with various suitable thermoplastics onto a receiving ring, such as mating ring 14.

Figure 2:
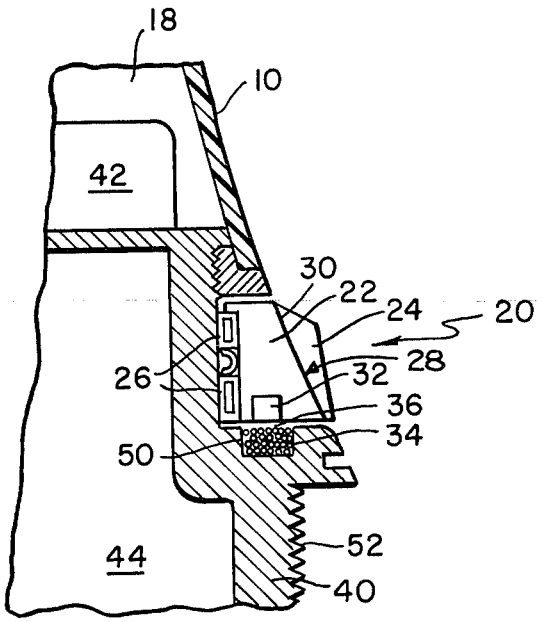
FIG. 2 is a partial view to an enlarged scale of one embodiment of the power generator.

Referring now to FIG. 2, the projectile electrical power generator comprises in combination the rotor 28 separated from the stator 34. The rotor 28 comprises an annular ring 22 encircling the fuse housing and mounted for rotation about the housing 40 on spring-restrained needle bearings 26, said annulus having disposed on the external contour 30 a plurality of fins 14. Both bearing and retaining springs may be selected from many that are commercially available. For example, the needle bearings shown could be replaced with much cheaper roller or ball bearings. Magnets 32 disposed about the annulus' aft surface are separated from the stator by an air gap 36, said stator comprising a plurality of coils and poles disposed within an annular groove 50 of the fuse housing. The annular rotor could be injection molded in one piece of some suitable heat and impact resistant plastic with the magnets attached therein. The stator coils and poles could be placed within the annular groove and expoxied in placed. By so orienting the electrical power generator for rotation about an outer fuse surface, a maximum housing volume is made available for target detection equipment and little internal space is required for the electrical power generating means.

Figure 3:
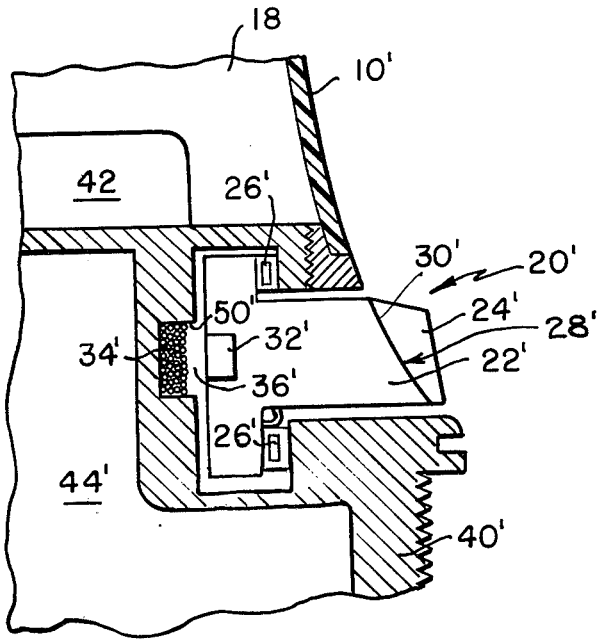

Referring now to FIG. 3, the projectile power generator comprises a variation wherein the encircling annulus 22' of rotor 28' is separated by radially disposed airgap 36' from stator 34'. Here both the annular rotor and the stator are located at essentially the same axial location of the projectile. In FIG. 2, both the annular rotor and the stator were located at essentially the same radial location, measured from the projectile axis, but were disposed at different axial locations. Rotor 28' has annular ring 22' encircling the fuse housing, said annulus having disposed on external contour 30' a plurality of fins 24' mounted for rotation about the fuse housing 40' on spring-retained bearings 26' within a void of the housing. Magnets 32' are disposed on an inner longitudinal surface of the annulus, adjacent the air gap separating the rotor from the stator coils and poles embedded within fuse annular groove 50'.

Either electrical power generating system hereinabove described achieves the desirable result that little internal fuse housing volume is required to accommodate the shaft, the rotor, or any means necessary to generate electricity for the fuse. A continuous unobstructed target detection signal processing path is permitted by the air responsive finned annular rotor while a smooth contoured path is still provided on the projectile's surface.

Obviously numerous modifications and variations of the present invention are possible in light of the above teachings. It is therefore to be understood that, within the scope of the appended claims, the invention may be practiced otherwise than as specifically described.

What is claimed as new and desired to be secured by Letters Patent of the United States is:

1. In combination with a projectile, a fuse comprising:

a substantially cylindrical housing having one end adapted for fitment within the projectile;

a streamlined nose portion mounted on the other end of the housing, said nose having an internal chamber;

target detection and signal processing means; and an electrical power generator for said fuse comprising: a wind driven annulus encircling the housing and rotable about the projectiles' longitudinal axis; a plurality of fins disposed around the circumferential surface of the annulus, the surface providing a smooth continuation between the nose portion and the projectile surface to expose the fins to the passing airstream; means to rotatably attach the annulus to the housing; magnetic means disposed on the annulus; and a stator disposed within an annular groove in the housing, said stator separated from the rotor element.

2. The combination as recited in claim 1 wherein said magnetic means is positioned on an aft surface of said annulus adjacent to said stator.

3. The combination as recited in claim 1 wherein said magnetic means is positioned on a longitudinal surface of the annulus adjacent to the stator.

4. An electrical power source for use in ordnance projectiles which comprises:

a support housing, said housing interior volume being substantially free for target detection means;

an annulus encircling the housing, said annulus mounted for rotation about the projectiles' longitudinal axis;

a plurality of fins disposed about the circumferential surface of the annulus, the surface providing a smooth contour to expose the fins to the airflow;

means cooperating with said annulus to generate electricity, said means comprising: magnetic means attached to the annulus; a stator disposed within an annular groove within said housing, such that when the airflow impinges upon the fins on said annulus, electrical energy is created by the relative rotation between the annulus and stator.

5. An electrical power source as recited in claim 4 wherein said magnetic means are positioned on an aft surface of said annulus adjacent to said stator.

6. An electrical power source as recited in claim 4 wherein said magnetic means are positioned on a longitudinal surface of the annulus adjacent to said stator.

* * * * *